United States Patent [19]

Dixon

[11] 4,354,304

[45] Oct. 19, 1982

[54] METHOD OF MAKING INTUMESCENT SEALS

[75] Inventor: Bernard Dixon, Pampisford, England

[73] Assignee: Dixon International Limited, Cambridge, England

[21] Appl. No.: 227,230

[22] Filed: Jan. 22, 1981

[30] Foreign Application Priority Data

Dec. 4, 1980 [GB] United Kingdom ..... 8038921

[51] Int. Cl.[3] ..... B22D 11/126

[52] U.S. Cl. ..... 29/527.1; 29/400 C; 29/530; 277/1; 277/9.5; 277/228; 277/DIG. 6; 264/318; 264/267; 264/269; 264/256

[58] Field of Search ..... 29/527.1, 527.2, 527.3, 29/156.6, 400 C, 402.02; 277/1, DIG. 6, 228, 9.5, 226, 215; 264/318, 259, 241, 242, 267, 268, 264, DIG. 77, 269, 274, 308, 275, 256

[56] References Cited

U.S. PATENT DOCUMENTS 2,538,406 1/1951 Allen ..... 29/527.1 X
3,439,406 4/1969 Wallin ..... 277/1

FOREIGN PATENT DOCUMENTS 618566 4/1961 Canada ..... 277/1
813225 5/1969 Canada ..... 277/1

*Primary Examiner*—Carl E. Hall
*Assistant Examiner*—V. K. Rising
*Attorney, Agent, or Firm*—Shapiro and Shapiro

[57] ABSTRACT

A method of making an intumescent seal comprises: providing a tubular holder having a longitudinal bore or interior chamber defined by a thickened longitudinally extending portion of the holder contiguous with a relatively thin wall of the holder; filling the bore of the holder with solid intumescent material; and thereafter removing a longitudinally extending part of said thickened portion thereby to leave part of said thickened portion as a baffle within the holder, the space left by said removed part forming a strait having a longitudinally extending opening to the exterior of the holder and a longitudinally extending opening to the bore of the holder. Preferably the thickened portion is square or rectangular and at a corner of the holder and the removal of said part of the thickened portion leaves two webs one of which constitutes the baffle and the other being at the exterior of the holder.

7 Claims, 12 Drawing Figures

METHOD OF MAKING INTUMESCENT SEALS

The present invention relates to a method of making intumescent seals, in particular tamper-resistant intumescent seals.

Known intumescent seals comprise an elongate holder containing intumescent material, the holder being provided with an opening or series of openings along its length. Such seals are fitted around doors or window openings, usually in the door or window frame. In the event of a fire, the intumescent material, when exposed to elevated temperature intumesces, that is it swells considerably and exudes through the opening or openings in the holder to seal any gap between the door or the window and the frame thereby preventing, or at least hindering, passage of smoke, flame and fumes past the door or window. This not only serves to retard spread of the fire but also assists in protecting people on the side of the door or window remote from the fire from the smoke and fumes produced by the fire.

A problem associated with such seals, especially when used in places frequented by children, such as schools, is that intumescent material is commonly removed from the holders by tamperers using pointed instruments as probes pushed into the holders through the openings.

To overcome this problem, it has been proposed to provide a baffle within the holder, the baffle restricting access to the intumescent material by a probe pushed into the holder through the opening. Our British Pat. No. 1529733 describes such intumescent seals. As disclosed in that patent, the intumescent seals comprise an elongate holder having an opening to the exterior of the holder, a baffle within the holder defining an interior chamber and a strait within the holder providing communication between the interior chamber and the opening. The interior chamber of the holder contains at least a major part of intumescent material in the holder. The intumescent material within the interior chamber can intumesce through the strait and out of the holder through the opening but the baffle restricts access to the interior chamber by a probe pushed through the opening by a tamperer.

A disadvantage of intumescent seals as described above, in which a baffle is present in the holder, is that it has not hitherto provided possible to manufacture such seals in an economic manner. This is because the holders, as articles of indefinite length and uniform cross section, have to be made by extrusion but the dies used are necessarily complex and will not stand up to the required pressures.

The present invention aims at overcoming or mitigating the disadvantage described above.

In accordance with the present invention, there is provided a method of making an intumescent seal comprising: providing a tubular holder having a longitudinal bore or interior chamber defined by a thickened longitudinally extending portion of the holder contiguous with a relatively thin wall of the holder; filling the bore of the holder with solid intumescent material; and thereafter removing a longitudinally extending part of said thickened portion thereby to leave part of said thickened portion as a baffle within the holder, the space left by said removed part forming a strait having a longitudinally extending opening to the exterior of the holder and a longitudinally extending opening to the bore of the holder.

The bore of the holder may be filled with the intumescent material by first filling the bore with a slurry or paste of a composition which subsequently hardens to form the intumescent material.

Preferably the removal of said part of the thickened portion leaves two webs, one of which constitutes the baffle and the other preferably being at the exterior of the holder. To this end, the thickened portion is preferably at a corner of the holder and is preferably square or rectangular in cross section.

The removal of said part of the thickened portion is conveniently effected by means of a saw or other cutting tool and leaves the opening from the strait into the bore of the holder defined between a free edge of the relatively thin wall portion and a free edge of the baffle.

The invention is further described below by way of example with reference to the accompanying drawings, wherein:

FIGS. 2A to 6A ("A" figures only) are cross sections of holders prior to filling with intumescent material; and FIGS. 3B to 6B ("B" figures only) are cross sections of intumescent seals made respectively from the holders of FIGS. 3A to 6B.

In the drawings, like reference numerals indicate like parts.

Figure 1A:
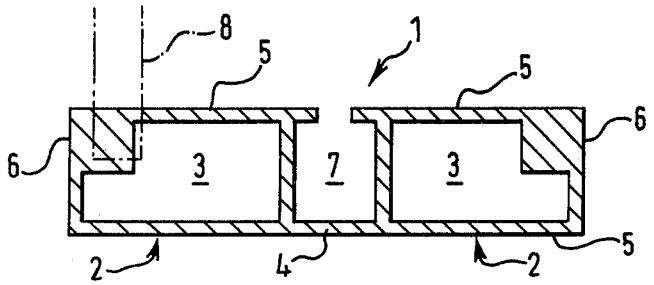
FIG. 1A is a cross section of a holder before filling with intumescent material.

Referring to FIG. 1A, a rigid holder 1 is elongate and of uniform cross section and comprises two tubular portions 2, each having a longitudinal bore or interior chamber 3 and being interconnected by a web 4. Each tubular portion 2 comprises relatively thin walls 5 and a contiguous relatively thick portion 6 at a corner of the holder, the portion 6 being of square cross section. A channel 7 is defined by facing walls of the two tubular portions 2 and the connecting web 4.

In making an intumescent seal, the bores 2 are filled with a composition in the form of a slurry which is allowed or caused to harden to form a solid coherent mass of intumescent material 20. Then a longitudinal saw cut bounded by dot-dash line 8 is made into each portion 6 to remove a part thereof. The saw cut breaks into the bore 3 but leaves a web 9 (see FIG. 1B) at the exterior of the holder and a web 10 within the holder. There is thus formed a strait 11 having an opening 12 to the exterior of the holder and an opening 13 to the longitudinal bore 3 of the holder.

Figure 1B:
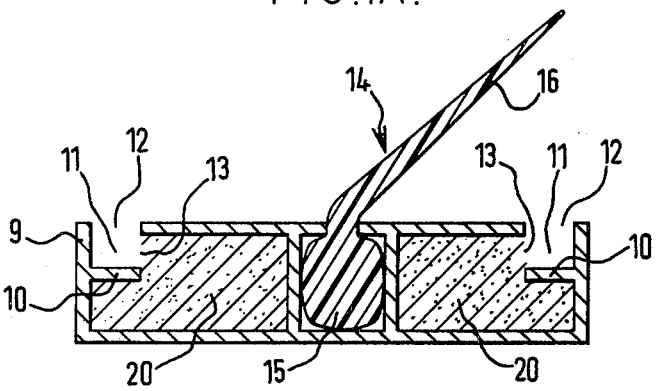
FIG. 1B is a cross section of an intumescent seal made from the holder of FIG. 1A.

The web 10 constitutes a baffle, which, as can be seen from FIG. 1B, restricts access to the bore or interior chamber 3 of the holder by a probe pushed through the opening 12 by a tamperer.

A resilient draught and smoke sealing element 14 may be fitted to the seal. The sealing element 14 has a foot portion 15 which is located in the channel 7 and a blade 16 which extends away from the channel.

The intumescent material in either of the tubular portions 2 can protect the sealing element from heat in the event of a fire. It is to be understood that it is not essential to provide the sealing element 14.

FIGS. 2A to 6A show other shapes of holders and FIGS. 2B to 6B show intumescent seals made therefrom.

Figure 2A:
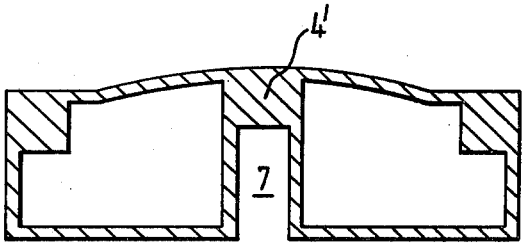
Figure 2B:
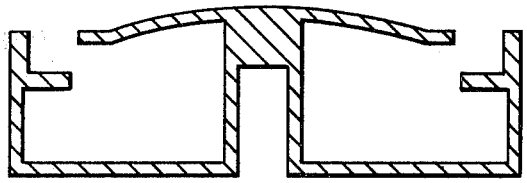

In the holder of FIGS. 2A and 2B the channel 7 faces in the opposite direction to the openings 12 in the intumescent seal, and the tubular portions are interconnected by a relatively thick portion 4'. The seal can be fixed to a structure such as a door by fasteners (e.g. nails) passed through the portion 4' and the channel 7 into the structure.

Figure 3A:
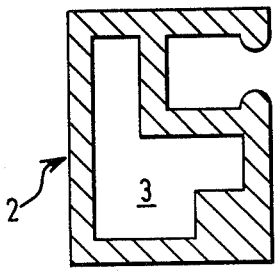
Figure 3B:
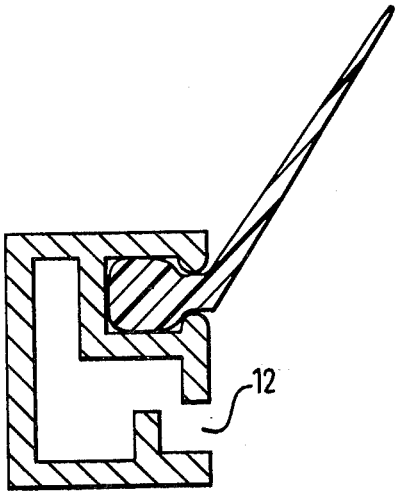

The holder of FIGS. 3A and 3B has only one tubular portion 2 and hence only one interior chamber 3. Ideally in use the opening 12 is disposed between the source of fire and the sealing element 13.

Figure 4A:
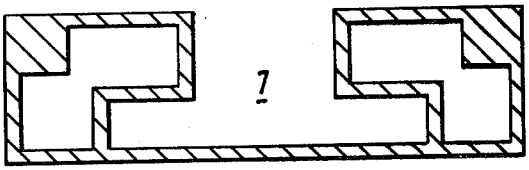
Figure 4B:
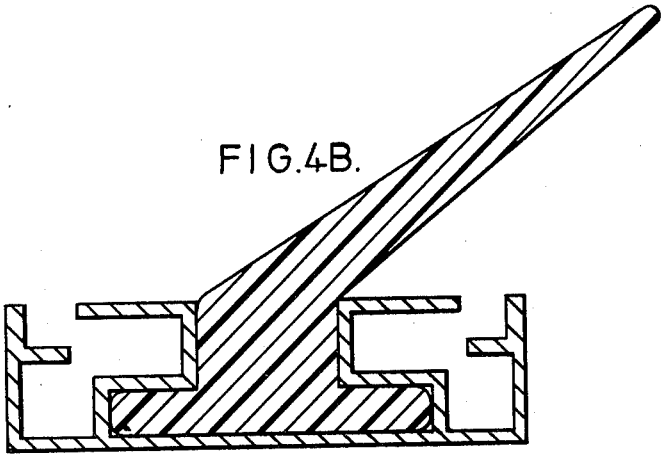

The holder of FIGS. 4A and 4B has an inverted T-shaped channel 7 to receive a correspondingly shaped base of a draught and smoke sealing element.

Figure 5A:
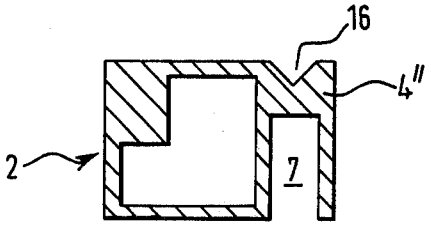
Figure 5B:
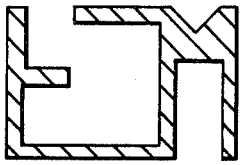

The holder of FIGS. 5A and 5B has only a single tubular portion 2 and the channel 7 faces in the opposite direction to the opening 12 in the seal. In alignment with the channel 7 is a shallow V-shaped channel 16 in portion 4'' of the holder. The seal can be fixed to a structure such as a door by fasteners (e.g. nails) passed through the portion 4'' and the channel 7 into the structure, heads of the fasteners being sunk into the channel 16.

Figure 6A:
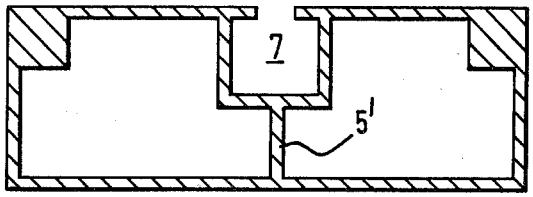
Figure 6B:
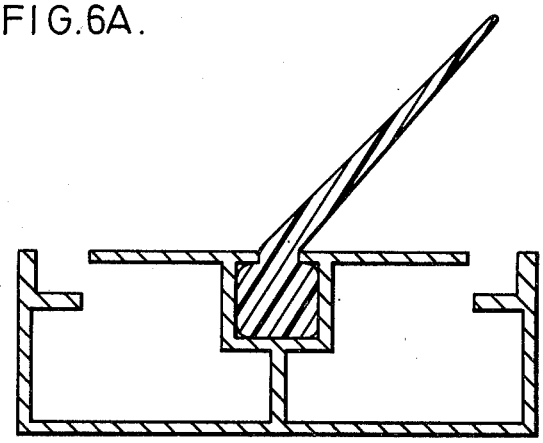

In the holder of FIGS. 6A and 6B the tubular portions have a common wall or web 5', there being no interconnecting web 4.

The holders described above and as shown in the "A" figures may be made by extrusion of aluminium, aluminium alloy or plastics material. Such plastics material preferably has inclusions of material of high thermal conductivity.

I claim:

1. A method of making an intumescent seal comprising: providing a tubular holder having a longitudinal bore or interior chamber defined by a thickened longitudinally extending portion of the holder contiguous with a relatively thin wall of the holder; filling the bore of the holder with solid intumescent material; and thereafter removing a longitudinally extending part of said thickened portion thereby to leave part of said thickened portion as a baffle within the holder, the space left by said removed part forming a strait having a longitudinally extending opening to the exterior of the holder and a longitudinally extending opening to the bore of the holder.

2. A method according to claim 1, wherein the bore of the holder is filled with the intumescent material by first filling the bore with a slurry or paste of a composition which subsequently hardens to form the intumescent material.

3. A method according to claim 1, wherein the removal of said part of the thickened portion leaves two webs, one of which constitutes the baffle.

4. A method according to claim 3, wherein the other web is at the exterior of the holder.

5. A method according to claim 4, wherein the thickened portion is at a corner of the holder.

6. A method according to claim 5, wherein the thickened portion is square or rectangular in cross section.

7. A method according to claim 1, wherein the removal of said part of the thickened portion is effected by means of a cutting tool and leaves the opening from the strait into the bore of the holder defined between a free edge of the relatively thin wall portion and a free edge of the baffle.

* * * * *